US005442256A

United States Patent [19]

Moyer et al.

[11] Patent Number: 5,442,256

[45] Date of Patent: Aug. 15, 1995

[54] SINGLE SUBSTRATE, VACUUM FLUORESCENT DISPLAY INCORPORATING TRIODE LIGHT EMITTING DEVICES

[75] Inventors: Curtis D. Moyer, Phoenix; James E. Jaskie, Scottsdale; John Song, Tempe, all of Ariz.

[73] Assignee: Motorola, Inc., Schaumburg, Ill.

[21] Appl. No.: 133,360

[22] Filed: Oct. 8, 1993

[51] Int. Cl.[6] ..... H01J 1/62

[52] U.S. Cl. ..... 313/496; 313/497

[58] Field of Search ..... 313/495–496, 313/309, 505, 310, 485, 497; 315/169.1, 169.3

[56] References Cited

U.S. PATENT DOCUMENTS

| | | | |
|---|---|---|---|
| 4,278,913 | 7/1981 | Kagami et al. | 313/495 |
| 4,280,125 | 7/1981 | Kazan | 313/495 |
| 5,202,609 | 4/1993 | Tomii et al. | 313/497 |
| 5,345,141 | 9/1994 | Moyer et al. | 313/496 |

*Primary Examiner*—Stephen Brinich
*Attorney, Agent, or Firm*—Eugene A. Parsons

[57] ABSTRACT

Manufacturing a single substrate fluorescent display including forming a first conductive layer on a substrate, depositing a first insulating layer on the first conductive layer, depositing a second conductive layer in horizontal rows on the first insulating layer, depositing a second insulating layer on the second conductive layer, and depositing an electron emitting layer of low work function material in columns on the second insulating layer so as to define a plurality of pixels at the column/row intersections. An opening is formed at each pixel extending through the layer of electron emitting material, the second insulating layer, the second conductive layer and the first insulating layer to the first conductive layer. A layer of light emitting material is deposited on the first conductive layer in the opening at each pixel.

32 Claims, 5 Drawing Sheets

SINGLE SUBSTRATE, VACUUM FLUORESCENT DISPLAY INCORPORATING TRIODE LIGHT EMITTING DEVICES

RELATED PATENT APPLICATIONS

A copending application entitled "Single Substrate, Vacuum Fluorescent Display", with Ser. No. 08/045,407, filed Mar. 29, 1993, now U.S. Pat. No. 5,345,141, issued Sep. 6, 1994, and assigned to the same assignee, is incorporated herein by reference.

FIELD OF THE INVENTION

The present invention pertains to vacuum fluorescent displays and more specifically to single substrate vacuum fluorescent displays incorporating improved light emitting devices.

BACKGROUND OF THE INVENTION

Vacuum fluorescent displays are currently used as the display device in many common home digital clocks and the like. In addition to the common blue-green clock display, a variety of colored displays and high resolution graphic displays are offered as products.

The basic operation of a vacuum fluorescent display involves the emission of electrons from a low work function thermionic filament cathode, the acceleration of the thermionically emitted electrons by an electric field and stimulation of a phosphor anode by the impacting electrons resulting in cathodoluminescent light generation in the phosphor.

In the vacuum fluorescent display, the filament cathode to phosphor anode voltage determines whether the phosphor emits light and the intensity of the emitted light. The vacuum fluorescent display is similar to the common cathode ray tube found in televisions and monitors, except that the cathode ray tube uses electromagnetics to direct electrons to the addressed pixel while the vacuum fluorescent display requires that illuminated pixels be individually biased. Some vacuum fluorescent displays utilize mesh grids to "gate" the electron flow to cathode areas, thereby, the mesh grid may be used to select which pixels to light. By using an array of filament cathodes and biasing individual pixels in combination with grid structures, a matrix addressed flat panel display results. In contrast, the cathode ray tube requires a large depth to allow for electron beam deflection.

In vacuum fluorescent displays, typical filament cathodes are tungsten wire coated with barium and strontium compounds that allow sufficient electron emission at approximately 10 volts bias at 600° C. filament temperature. The common phosphor used at this low bias voltage is ZnO:Zn, which gives a blue-green cathodoluminescent light emission.

A common $\frac{3}{4}''$ by 3" clock module draws approximately 300 mW to bias the filament (for heating). Further, because of the hot filaments the spacing between the hot filaments and the phosphor is substantial, currently the thickness is approximately $\frac{1}{4}''$.

The above described and related patent application discloses a single substrate, vacuum fluorescent display incorporating diode light generating devices. One drawback of the diode light generating devices is the fact that the distance between the emitter and the anode is limited by operating voltages. That is, a close spacing must be maintained between the phosphor at the anode and the diamond material at the emitter. The spacing between the anode and the emitter and the applied bias set the extraction field which then determines the electron emission current from the emitter. Because the described spacing is between the phosphor and the diamond emitter, much care must be used in depositing the phosphor.

Many phosphors are prepared at high temperatures as powders. Typical powder phosphor based devices utilize inexpensive substrates (glass) that would not stand up to the temperatures needed to fabricate efficient phosphors. Further, the use of phosphor powders allows the manufacturing process to sequentially deposit and pattern different phosphor powder, which allows the fabrication of color displays. Phosphor powder particle sizes are in the several micron range. However, the spacing between the anode and the emitter generally utilized in the diode device of the above described patent application is about $1\pm0.1$ micron. Generally, the light emitting devices in the above described patent application are limited to using thin film phosphors or very fine grained electrophoretically deposited powder phosphors. This limitation increases the cost and complexity of fabrication.

Thus, a single substrate vacuum fluorescent display in which simple and inexpensive phosphor powders can be utilized as the light emitting layer without requiring special fabrication techniques is highly desirable.

Accordingly, it is a purpose of the present invention to provide a new and improved single substrate vacuum fluorescent display incorporating triode light emitting devices.

It is a further purpose of the present invention to provide a new and improved single substrate vacuum fluorescent display incorporating triode light emitting devices in which the spacing between an emitter and a phosphor carrying anode is not critical to the operation.

It is a still further purpose of the present invention to provide a new and improved single substrate vacuum fluorescent display incorporating triode light emitting devices which are simple and relatively inexpensive to manufacture.

It is yet another purpose of the present invention to provide a new and improved single substrate vacuum fluorescent display incorporating triode light emitting devices in which inexpensive phosphor powders can be utilized.

It is still another purpose of the present invention to provide a new and improved single substrate vacuum fluorescent display incorporating triode light emitting devices in which inexpensive phosphor powders can be simply and easily incorporated into the anode structure.

SUMMARY OF THE INVENTION

The above described problems and others are substantially solved and the above purposes and others are realized in a single substrate fluorescent display utilizing a triode light emitting device comprising a supporting substrate having an anode positioned thereon with a layer of light emitting material in contact therewith, a grid spaced from the anode and supported by the substrate, and an emitter spaced from the grid and supported by the grid. The emitter and light emitting material are further positioned so that emitted electrons strike the light emitting material.

The above described problems and others are substantially solved and the above purposes and others are further realized in a single substrate fluorescent display including a triode light emitting device with a supporting substrate and a first layer of electrically conductive material positioned on the substrate so as to form a triode anode. A first insulating layer having a predetermined height is positioned on the first layer of electrically conductive material. A light emitting layer including phosphor, having a height less than the predetermined height, is positioned on the first layer of electrically conductive material and adjacent the first insulating layer. A second layer of electrically conductive material is supported on the first insulating layer and electrically insulated from the first layer of electrically conductive material so as to form a triode gate. A second insulating layer is positioned on the second layer of electrically conductive material and an electron emitting layer of low work function material is positioned on the second insulating layer so as to form a triode emitter and further positioned so that emitted electrons strike the light emitting layer. The first insulating layer determines the spacing between the anode and the grid, which is not critical, so that adequate space can be provided to use phosphor powders and the like in the fabrication of the light emitting layer of the anode.

BRIEF DESCRIPTION OF THE DRAWINGS

Referring to the drawings.

DESCRIPTION OF THE PREFERRED EMBODIMENT

Figure 1:
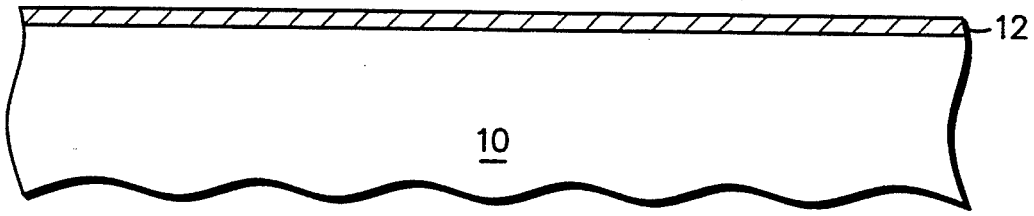
FIGS. 1 through 4 are simplified sectional views of various steps in the fabrication of a single substrate display embodying the present invention.

Simplified sectional views of various steps in the fabrication of a single substrate display embodying the present invention are illustrated in FIGS. 1 through 4. Specifically, FIG. 1 illustrates a substrate 10 having a layer of electrically conductive material 12 positioned thereon. Substrate 10 can be formed of any convenient material, such as glass, metal, a semiconductor wafer, etc. If, for example, it is desired that substrate 10 be the light output (screen) for the final device, substrate 10 is formed of an optically transparent glass and conductive material 12 is formed of an optically transparent, electrically conductive material such as indium-tin-oxide (ITO). Here it should be understood that the term "optically transparent" refers to the light waves generated within the device, which should be substantially freely transmitted therethrough. In other applications, it may be desirable to make substrate 10 on a semiconductor wafer and to include drive electronics thereon to reduce external connections etc. Where substrate 10 is a semiconductor wafer, conductive layer 12 can be a highly doped portion or layer adjacent the surface thereof.

Figure 2:
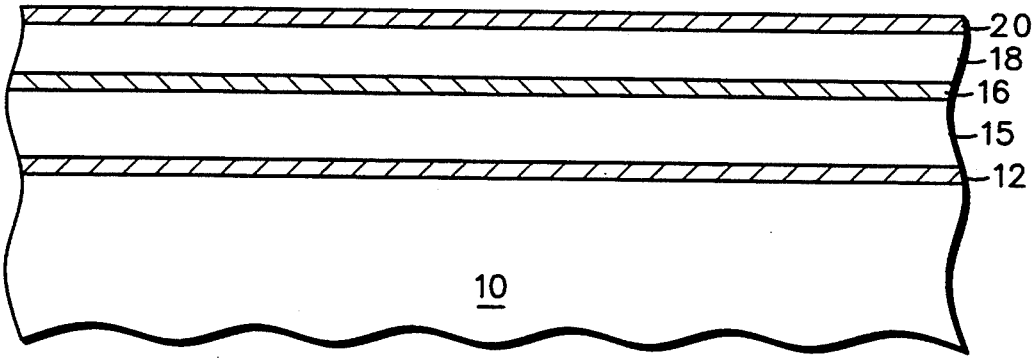

Referring specifically to FIG. 2, a first insulating layer 15 of material is deposited in a blanket layer over conductive layer 12. Insulating layer 15 can be formed of any convenient insulating material such as $SiO_2$, glass or the like. Further, insulating layer 15 is formed with a predetermined thickness determined by other fabrication steps to be explained presently. Briefly, the thickness of insulating layer 15 is in the range of 1 to several microns (generally less than 10 microns). It should be noted, however, that insulating layer 15 can be formed with a substantially larger thickness if desired. A second electrically conductive layer 16 is deposited in a blanket layer on insulating layer 15. Conductive layer 16 can be any convenient conductive material, such as metal or a highly doped semiconductor layer. A second insulating layer 18, which again may be any convenient insulating material, such as $SiO_2$, glass, etc. is deposited over conductive layer 16 in a blanket layer. Generally, second insulating layer 18 is in a range of approximately 1–10 microns thick.

An electron emitting layer 20 is deposited on insulating layer 18 in a blanket layer. Electron emitting layer 20 is generally composed of an electron emitting low work function material. An electron emitting low work function material includes any material that easily emits electrons with a relatively low bias voltage, such as diamond, various metals such as aluminum or gallium with cesium or cesium and oxygen activated surfaces, etc. Diamond is preferred for layer 20 because of the tendency for most other materials to deteriorate with use. Layer 20 may include diamond grit, CVD diamond, a diamond film (see U.S. Pat. No. 5,128,006, entitled "Deposition of Diamond films on Semiconductor Substrates" issued Jul. 7, 1992, for an example of diamond films.), diamond-like carbon, other deposited diamond, a metal based field emission structure, a diamond and metal multilayer structure, or other suitable electron source. When diamond is used for layer 20, it is preferred that layer 20 be capped with a conductive material in a way that yields ohmic contact. The capping material can be titanium followed by gold or aluminum, for example, or it could be molybdenum, or titanium-tungsten, as further possible examples. In many instances, to insure good conductivity for electrons throughout the emitting material, it is desirable to sandwich the layer of diamond or diamond-like material between two electrically conductive, or metal, layers. Also, a high resistivity ballasting may be incorporated into electron emitting layer 20 to provide a ballast for each of the devices to prevent run-away conditions.

Figure 3:
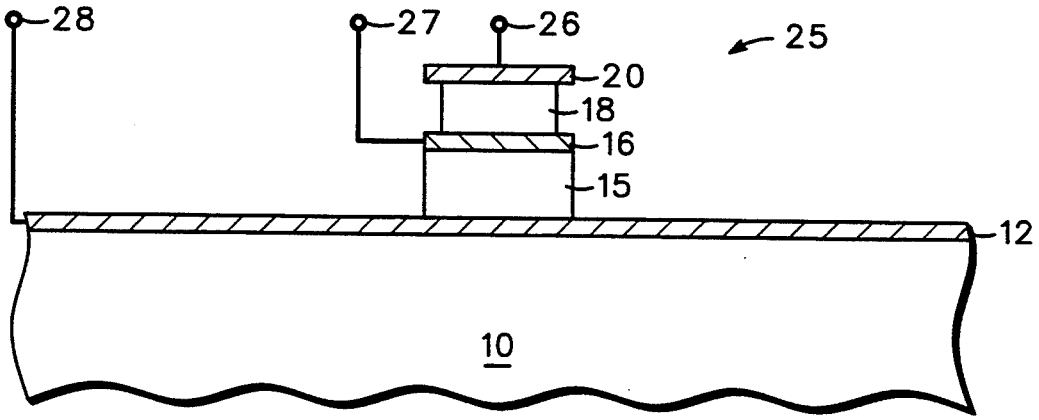

The structure of FIG. 2 is then photo-lithographically patterned, etched and the photoresist is then removed to form a device 25, illustrated in cross-section in FIG. 3. Device 25 represents an area in a display that will become a light emission site and can be a single pixel, a single element of a color pixel triad, or one of several redundant sites within a pixel or triad element. Device 25 is a triode in which conductive layer 12 operates as the anode, conductive layer 16 operates as the grid and electron emitting layer 20 operates as the emitter.

In operation, a positive anode voltage is applied to conductive layer 12, a lesser but positive gate voltage is applied to conductive layer 16 and a negative bias (relative to the gate voltage) is applied to electron emitting layer 20. An electric field developed between electron emitting layer 20 and conductive layer 16 is set by the gate to emitter bias voltage (and to a lesser extent by the anode voltage) and by the thickness of insulating layer 18. The electric field at electron emitting layer 20 causes electrons to be emitted from the diamond or other material of electron emitting layer 20, which emitted electrons are then accelerated toward conductive layer 12 by the positive bias thereon. An emitter terminal 26, a gate terminal 27 and an anode terminal 28 are provided for applying the various voltages and biases using methods and materials well known in the art.

Figure 4:
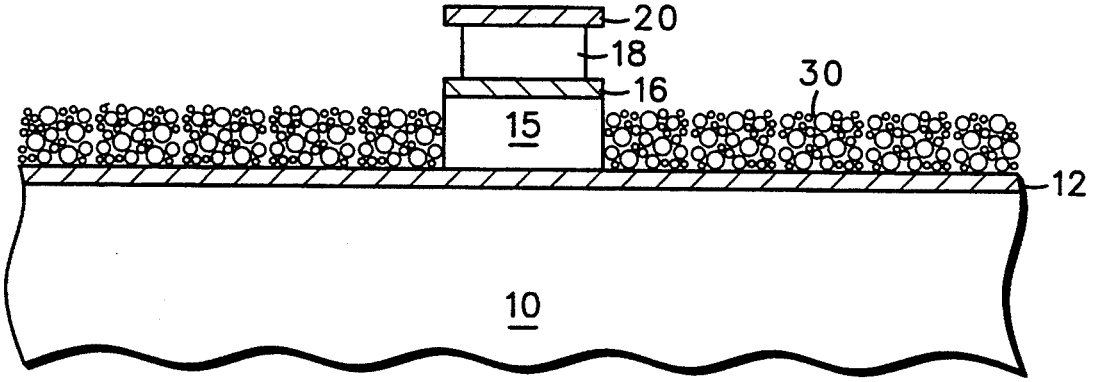

Referring specifically to FIG. 4, device 25 of FIG. 3 is illustrated after additional fabrication steps have been performed. A light emitting layer 30 is deposited on the exposed surface of conductive layer 12 by settling of phosphor powder from a wet solution and patterning. In the case of color triads, the phosphor has a preselected color. Phosphor can alternatively be deposited by electrophoresis of phosphor powder, film deposition, or other methods known in the art. Here it should be noted that phosphor powders can be purchased on the market relatively inexpensively. Further, phosphor powders having a particle size which is relatively constant throughout the batch can be purchased with no substantial increase in the cost.

For example, a batch of commonly available ZnO:Zn phosphor powder having a particle size of approximately 2 microns can be purchased on the market. The material is then suspended in any well known suitable liquid. In this specific instance the thickness of insulating layer 15 is preset at approximately 5 microns. The suspension is then applied to the exposed surface of conductive layer 12 and allowed to settle. After settling, the device is heated in an oven to remove any remaining portions of the liquid and to fix the phosphor powder into a firm layer, as illustrated in FIG. 4.

Figure 5:
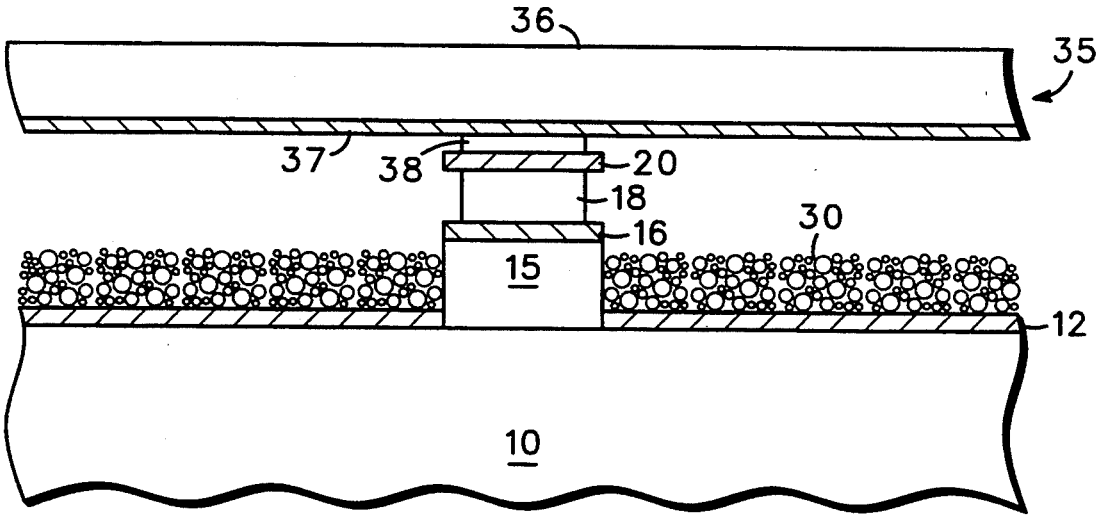
FIG. 5 illustrates a single substrate display similar to that illustrated in FIG. 4, with additional components added.

Referring specifically to FIG. 5, an encapsulation layer 35 is illustrated in position over device 25. Encapsulation layer 35 includes an insulating layer 36, which may be glass in the event that it is to serve as the light outlet or screen for device 25. Further, a thin conductive layer 37 is formed on the inner surface of insulating layer 36 to drain off any charge that might accumulate on the inner surface of insulating layer 36. If encapsulation layer 35 is to serve as the screen for device 25 and conductive layer 37 is utilized, it should be formed of an optically transparent material such as ITO. If encapsulation layer 35 does not serve as the screen, or the light output, layer 37 can either include or be coated with a getter to reduce the collection of unwanted gases within the encapsulated area. Encapsulation layer 35 is supported in the encapsulating position over device 25 by providing a layer of insulating material 38 overlying electron emitting layer 20 and serving as a spacer between encapsulation layer 35 and electron emitting layer 20.

Figure 6:
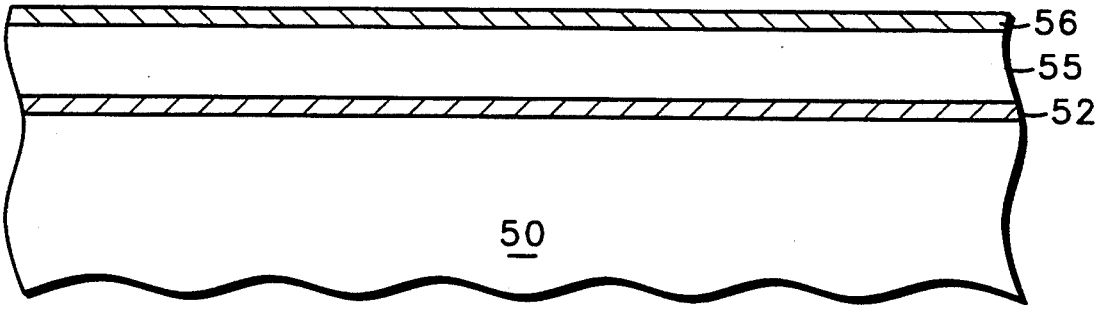
FIG. 6 is a simplified sectional view of an intermediate step and resulting structure in a different embodiment of a single substrate display incorporating the present invention.
Figure 7:
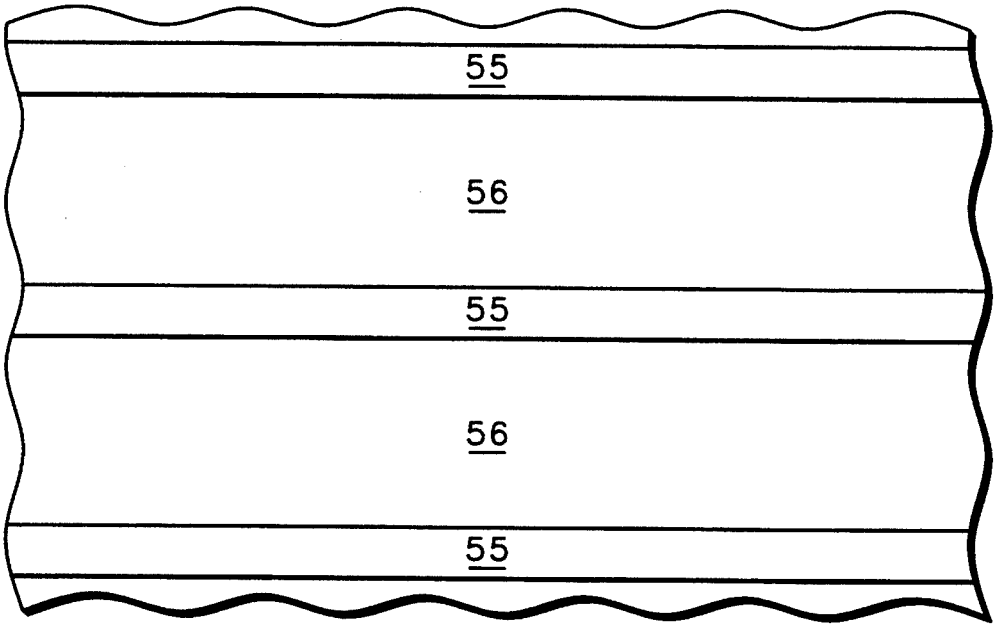
FIG. 7 is a top plan view of the structure of FIG. 6.
Figure 8:
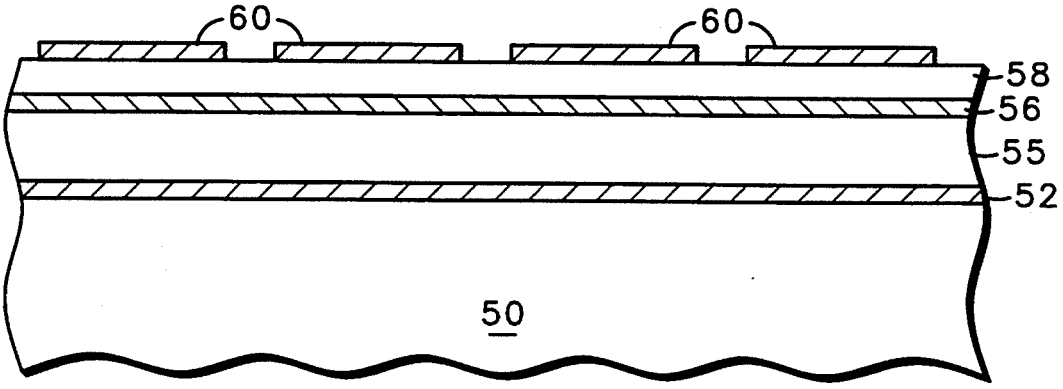
FIG. 8 is a view similar to FIG. 6 illustrating additional fabrication steps and the resulting structure.
Figure 9:
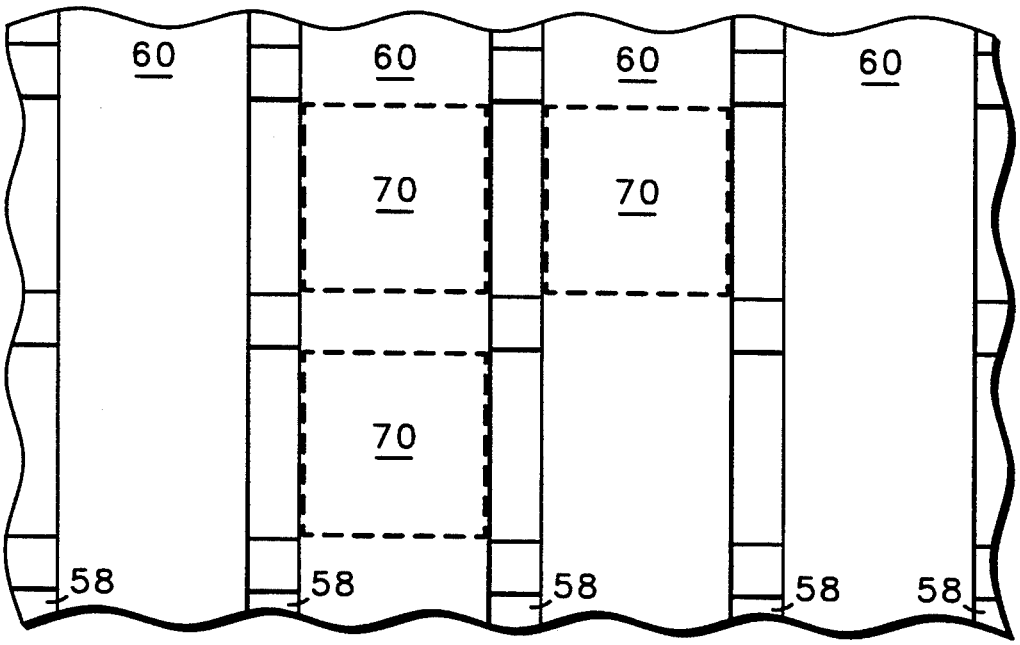
FIG. 9 is a top plan view of the structure of FIG. 8.
Figure 10:
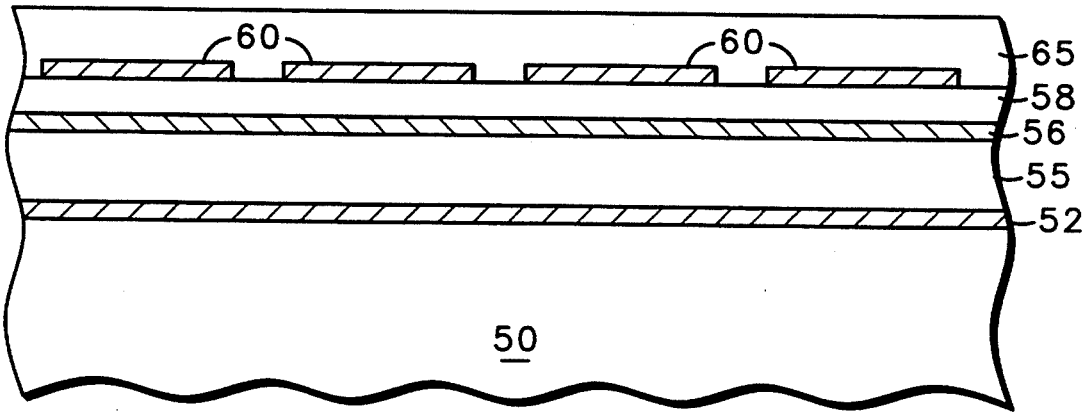
FIG. 10 is a view similar to FIG. 8 illustrating additional fabrication steps and the resulting structure.
Figure 11:
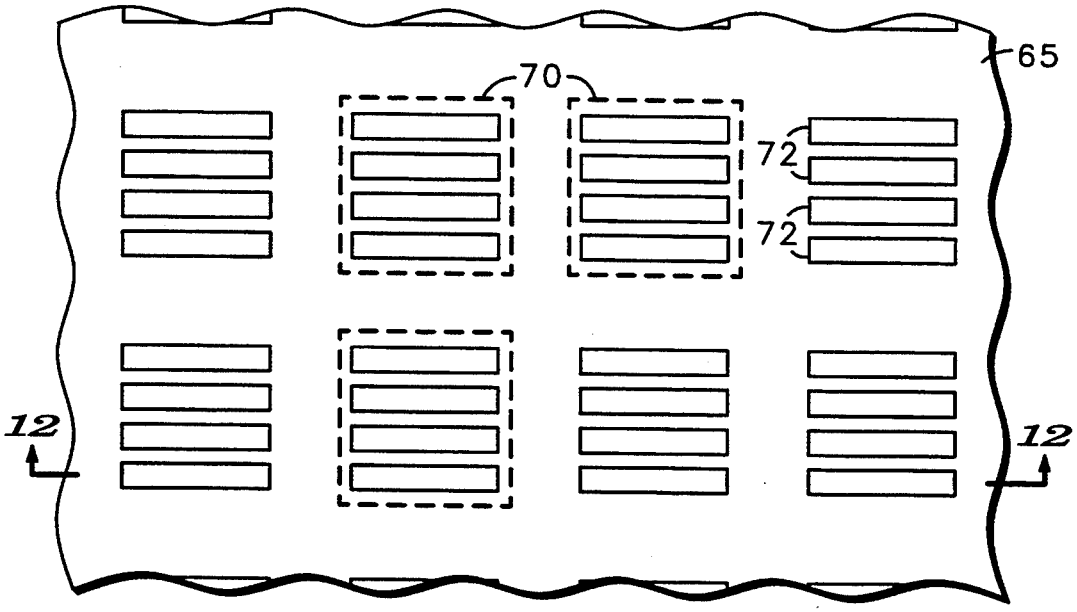
FIG. 11 is a top plan view of structure similar to FIG. 10 illustrating additional fabrication steps and the resulting structure.

Referring to FIGS. 6 and 7, cross-sectional and top plan views of an interim structure in the fabrication of a single substrate, fluorescent display embodying the present invention are illustrated. A substrate 50, which is similar to substrate 10 of the previous figures, has a conductive layer 52 positioned thereon. An insulating layer 55 is positioned on conductive layer 52 and a second conductive layer 56 is deposited on insulating layer 55 in rows, as illustrated more clearly in FIG. 7. The rows can be formed by using any of the well known methods, such as selective deposition, patterning with photoresist and etching, etc. A second insulating layer 58 is positioned over conductive layer 56, preferably so as to substantially planarize the surface of insulating layer 58, and an electron emitting layer 60 is formed in columns over insulating layer 58, as illustrated more clearly in FIG. 9. Electron emitting layer 60 is generally similar to layer 20 of the previous embodiment and the columns are formed as described above with relation to the rows of layer 56. Here it should be noted that cross-over areas, herein designated 70 and illustrated with a broken line, at which the columns of conducting layer 60 overlie the rows of conducting layer 56 each define a light emitting device or pixel of the display.

In this specific embodiment, an insulating layer 65 is positioned over the columns of conductive layer 60, preferably so as to substantially planarize the surface of insulating layer 65. One or more openings 72 are then etched through insulating layer 65, conductive layer 60, insulating layer 58, conductive layer 56 and insulating layer 55 at each of cross-over areas 70. Thus, the upper surface of conductive layer 52 is exposed at the bottom of each of the openings 72. In the present embodiment four openings 72 are formed at each cross-over area 70 but a single opening could be formed, three openings 72 could be formed with each representing a different color of a triad, smaller square or round openings could be formed, depending upon the application, the process steps utilized and other fabrication factors.

After the formation of openings 72, a light emitting layer 75 is deposited on the exposed surface of conductive layer 52 at the bottom of each opening 72. In this specific embodiment, light emitting layer 75 is deposited on the exposed surface of conductive layer 52 by settling of phosphor powder from a wet solution. In the case of color triads, the phosphor has a preselected color for each of the different openings 72. Phosphor can alternatively be deposited by electrophoresis of phosphor powder, film deposition, or other methods known in the art. After light emitting layer 75 is deposited, any patterning or photoresist layers that were utilized in the process are removed and an encapsulation layer (not shown) is positioned and sealed over the upper ends of openings 72. As explained above, either substrate 50 or the encapsulation layer can be utilized as the screen of the display.

Figure 12:
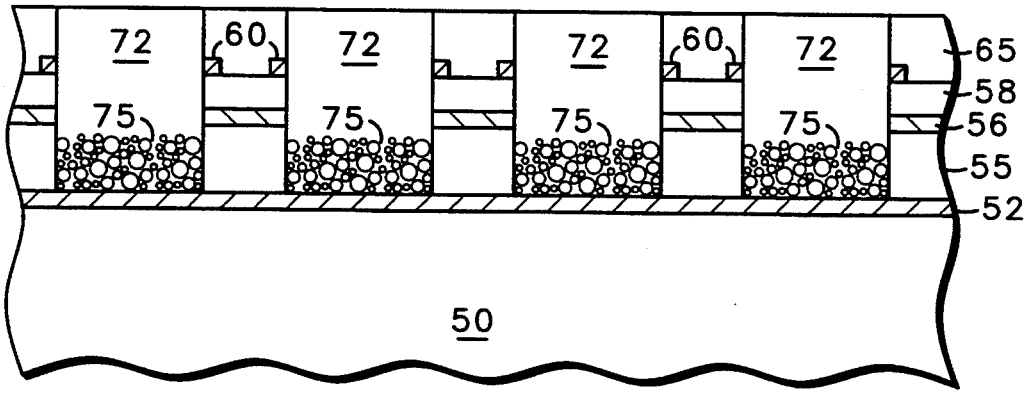
FIG. 12 is a cross-sectional view of the structure of FIG. 11 as seen from the line 12—12 of FIG. 11.

Since the operation of the devices described, referring to either FIGS. 4, 5 or 12 for easiest understanding, depend chiefly on the spacing between the emitter and gate, the spacing between the gate and anode can be substantially any predetermined thickness. Thus, the spacing or thickness between the gate and anode can be set to allow substantially any type of light emitting layer (e.g., phosphor powder) and any convenient method of depositing the light emitting layer on the anode so that emitted electrons strike the light emitting layer. This greatly relaxes restrictions on the materials which can be utilized and the methods of depositing the materials.

Thus, a new and improved single substrate vacuum fluorescent display incorporating triode light emitting devices is disclosed. Further, the various disclosed embodiments of single substrate vacuum fluorescent displays include triode light emitting devices in which the spacing between an emitter and a phosphor carrying anode is not critical to the operation. Also, the triode light emitting devices are simple and relatively inexpensive to manufacture, especially in view of the fact that inexpensive phosphor powders can be utilized and easily incorporated into the anode structure.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

What is claimed is:

1. In a single substrate fluorescent display, a triode light emitting device comprising a supporting substrate having an anode positioned thereon with a layer of light emitting material in contact therewith, a grid spaced from the anode by an insulating layer supported by the substrate, and an edge emitting electrode spaced-from the grid by an insulating layer supported by the grid, the emission of the edge emitting electrode being controlled in part by electrode-grid spacing.

2. In a single substrate fluorescent display, a triode light emitting device as claimed in claim 1 wherein the layer of light emitting material has a predetermined thickness and the grid is spaced from the anode a distance greater than the predetermined thickness.

3. In a single substrate fluorescent display, a triode light emitting device comprising:

a supporting substrate;

a first layer of electrically conductive material positioned on the substrate so as to form a triode anode;

a first insulating layer positioned on the first layer of electrically conductive material and having a predetermined height;

a light emitting layer including phosphor positioned on the first layer of electrically conductive material and adjacent the first insulating layer, the light emitting layer having a height less than the predetermined height;

a second layer of electrically conductive material supported on the first insulating layer and electrically insulated from the first layer of electrically conductive material so as to form a triode gate;

a second insulating layer positioned on the second layer of electrically conductive material; and an electron emitting layer of low work function material positioned on the second insulating layer so as to form a triode emitter and further positioned so that emitted electrons strike the light emitting layer.

4. In a single substrate fluorescent display, a triode light emitting device as claimed in claim 3 wherein the second layer of electrically conductive material and the electron emitting layer are patterned into rows and columns to form a matrix of pixels.

5. In a single substrate fluorescent display, a triode light emitting device as claimed in claim 4 wherein the electron emitting layer and the second layer of electrically conductive material are patterned to form a pixel at each juncture of the rows and columns.

6. In a single substrate fluorescent display, a triode light emitting device as claimed in claim 5 wherein the light emitting layer is patterned to form a pixel at each juncture of the rows and columns.

7. In a single substrate fluorescent display, a triode light emitting device as claimed in claim 5 wherein the second layer of electrically conductive material and the emitting layer include metal patterned to form strips of conductive metal positioned in rows and columns.

8. In a single substrate fluorescent display, a triode light emitting device as claimed in claim 3 wherein the supporting substrate is an insulating substrate.

9. In a single substrate fluorescent display, a triode light emitting device as claimed in claim 3 wherein the supporting substrate includes a semiconductor material with a heavily doped layer forming the first layer of electrically conductive material.

10. In a single substrate fluorescent display, a triode light emitting device as claimed in claim 3 wherein the supporting substrate is an optically transparent material.

11. In a single substrate fluorescent display, a triode light emitting device as claimed in claim 3 wherein the electron emitting layer includes diamond grit.

12. In a single substrate fluorescent display, a triode light emitting device as claimed in claim 3 wherein the electron emitting layer includes a diamond film.

13. In a single substrate fluorescent display, a triode light emitting device as claimed in claim 3 including in addition an encapsulation layer spaced from the substrate and encapsulating the anode, gate and emitter of the triode.

14. In a single substrate fluorescent display, a triode light emitting device as claimed in claim 3 wherein the layer of light emitting material includes phosphor particles.

15. In a single substrate fluorescent display, a triode light emitting device as claimed in claim 3 wherein the second layer of electrically conductive material and the electron emitting layer are formed in rows and columns, respectively, with positions at which each row of the second layer of electrically conductive material crosses each column of the electron emitting material defining a pixel.

16. In a single substrate fluorescent display, a triode light emitting device as claimed in claim 15 wherein each pixel includes an opening extending through the layer of electron emitting material, the second insulating layer, the second layer of electrically conductive material and the first insulating layer to the first layer of electrically conductive material, and the layer of light emitting material is positioned on the first layer of electrically conductive material in the opening.

17. In a single substrate fluorescent display, a triode light emitting device as claimed in claim 3 wherein the electron emitting layer includes a layer of diamond-like material sandwiched between two layers of metal.

18. A single substrate fluorescent display including triode light emitting devices, the display comprising:

a supporting substrate;

a first layer of electrically conductive material positioned on the substrate;

a first insulating layer positioned on the first layer of electrically conductive material;

a second layer of electrically conductive material supported on the first insulating layer and electrically insulated from the first layer of electrically conductive material, the second layer of electrically conductive material being formed into a plurality of horizontally spaced apart rows;

a second insulating layer positioned on the second layer of electrically conductive material;

an electron emitting layer of low work function material positioned on the second insulating layer and electrically insulated from the first and second electrically conductive layers, the electron emitting layer being formed into a plurality of horizontally spaced apart columns with positions at which each column overlies each row defining a pixel;

an opening extending through the layer of electron emitting material, the second insulating layer, the second layer of electrically conductive material and the first insulating layer to the first layer of electrically conductive material at each pixel; and a layer of light emitting material positioned on the first layer of electrically conductive material in the opening at each pixel and further positioned so that emitted electrons strike the light emitting layer.

19. A single substrate fluorescent display as claimed in claim 18 wherein the first insulating layer has a predetermined thickness and the layer of light emitting material has a thickness less than the predetermined thickness.

20. A single substrate fluorescent display as claimed in claim 18 wherein the electron emitting layer of low work function material includes diamond.

21. A single substrate fluorescent display as claimed in claim 18 wherein the layer of light emitting material includes phosphor powder.

22. A single substrate fluorescent display as claimed in claim 18 including in addition a third insulating layer positioned on the electron emitting layer with the opening at each pixel extending therethrough.

23. A single substrate fluorescent display as claimed in claim 22 including in addition an encapsulation layer positioned on the third insulating layer.

24. A single substrate fluorescent display as claimed in claim 23 wherein the encapsulation layer includes an electrically conductive layer formed therein.

25. A method of manufacturing a single substrate fluorescent display comprising the steps of:

providing a supporting substrate;

depositing a first layer of electrically conductive material on the substrate;

depositing a first insulating layer on the first layer of electrically conductive material, the first insulating layer having a predetermined height;

depositing a light emitting layer including phosphor on the first layer of electrically conductive material and adjacent the first insulating layer, the light emitting layer having a height less than the predetermined height;

depositing a second layer of electrically conductive material on the first insulating layer and electrically insulated from the first layer of electrically conductive material;

depositing a second insulating layer on the second layer of electrically conductive material; and depositing an electron emitting layer of low work function material on the second insulating layer and further positioned so that emitted electrons strike the light emitting layer.

26. A method of manufacturing a single substrate fluorescent display incorporating triode light emitting devices comprising the steps of:

providing a supporting substrate with a planar upper surface;

forming a first layer of electrically conductive material on the surface of the substrate;

depositing a first layer of insulating material on the first layer of electrically conductive material;

forming a second layer of electrically conductive material on the first layer of insulating material, the second layer of electrically conductive material being formed into a plurality of horizontally spaced apart rows;

depositing a second layer of insulating material on the second layer of electrically conductive material;

depositing an electron emitting layer of low work function material in columns on the second layer of insulating material so as to define a plurality of pixels, each position at which a column overlies a row defining a pixel;

forming an opening at each pixel extending through the layer of electron emitting material, the second layer of insulating material, the second layer of electrically conductive material and the first layer of insulating material to the first layer of electrically conductive material; and depositing a layer of light emitting material on the first layer of electrically conductive material in the opening at each pixel, the layer of light emitting material being further positioned so that electrons emitted by the electron emitting layer strike the layer of light emitting material.

27. A method of manufacturing a single substrate, vacuum fluorescent display as claimed in claim 26 wherein the step of depositing an electron emitting layer of low work function material includes depositing a layer of diamond.

28. A method of :manufacturing a single substrate, vacuum fluorescent display as claimed in claim 26 including in addition the step of depositing a third layer of insulating material on the electron emitting layer prior to the step of forming an opening at each pixel, and the step of forming an opening at each pixel includes extending the opening through the third layer of insulating material.

29. A method of manufacturing a single substrate, vacuum fluorescent display as claimed in claim 28 including in addition the step of encapsulating the light emitting and electron emitting layers by positioning an encapsulation layer over the third layer of insulating material.

30. A method of manufacturing a single substrate, vacuum fluorescent display as claimed in claim 26 wherein the step of depositing a layer of light emitting material includes the steps of forming a phosphor powder into a wet solution, introducing the wet solution into each of the openings and settling the phosphor powder in the wet solution onto the first layer of electrically conductive material in the openings.

31. A method of manufacturing a single substrate, vacuum fluorescent display as claimed in claim 26 wherein the step of depositing a layer of light emitting material includes electrophoretically depositing a phosphor powder.

32. A method of manufacturing a single substrate, vacuum fluorescent display as claimed in claim 26 wherein the step of depositing an electron emitting layer of low work function material includes the steps of depositing a third layer of electrically conductive material on the second layer on insulating material, depositing a layer containing diamond-like material on the third layer of electrically conductive material and depositing a fourth layer of electrically conductive material on the layer of diamond-like material.

* * * * *